United States Patent [19]

Kerch

[11] 4,215,669

[45] Aug. 5, 1980

[54] HOT AIR FURNACE

[75] Inventor: Ronald C. Kerch, Bloomington, Ind.

[73] Assignee: Multi-Fuel Energy Systems, Inc., Indianapolis, Ind.

[21] Appl. No.: 927,498

[22] Filed: Jul. 24, 1978

[51] Int. Cl.[2] ..... F24H 3/00

[52] U.S. Cl. ..... 126/99 R; 126/112; 237/51

[58] Field of Search ..... 126/121, 131, 117, 118, 126/112, 75, 99 R, 154, 103, 153, 289, 292; 110/322, 326; 237/51

[56] References Cited

U.S. PATENT DOCUMENTS

| | | | |
|---|---|---|---|
| 345,991 | 7/1886 | Reynolds . | |
| 396,905 | 1/1889 | Wells | 126/103 X |
| 503,817 | 8/1893 | Watson . | |
| 1,188,562 | 6/1916 | Schaffan | 126/134 |
| 1,211,657 | 1/1917 | Atteberry | 126/103 |
| 1,570,489 | 1/1926 | Hill | 126/112 X |
| 1,609,788 | 12/1926 | Anderson | 126/112 |
| 1,681,449 | 8/1928 | Walters | 126/121 |
| 2,083,745 | 6/1937 | Risdon | 126/101 |
| 2,130,894 | 9/1938 | Muir | 126/101 |
| 2,153,942 | 4/1939 | Spalding, Jr. | 126/117 X |
| 2,466,868 | 4/1949 | Scott et al. | 126/117 X |
| 2,569,781 | 10/1951 | Schrank | 126/75 |
| 2,810,380 | 10/1957 | Critten | 126/104 |
| 2,822,136 | 2/1958 | Dalin | 237/17 |
| 3,213,846 | 10/1965 | Rodgers, Jr. et al. | 126/153 X |
| 3,934,554 | 1/1976 | Carlson | 122/176 |
| 4,076,011 | 2/1978 | Proulx | 126/121 |
| 4,078,541 | 3/1978 | Roycraft | 126/112 X |
| 4,095,581 | 6/1978 | Billmeyer et al. | 126/121 |
| 4,106,475 | 8/1978 | Mayes | 126/121 |
| 4,111,181 | 9/1978 | Canney | 126/112 X |
| 4,135,488 | 1/1979 | Wells | 126/121 |

*Primary Examiner*—Carroll B. Dority, Jr.
*Assistant Examiner*—Randall L. Green
*Attorney, Agent, or Firm*—Woodard, Weikart, Emhardt & Naughton

[57] ABSTRACT

A modular furnace for adaptation to a conventional domestic heating system includes a firebox which is enclosed on both sides, the top and the bottom. The front portion of the firebox includes an access door for introduction of the combustible fuel onto a grate, and the back of the firebox includes a first opening for an air inlet tube and a second opening for air flow beneath the grate. The inlet tube extends above the grate and provides a single air outlet adjacent the front portion. Surrounding a majority of the firebox is an external housing and extending up the sides and front portion of the firebox between the firebox and the housing are a plurality of air flow passageways. These passageways extend across a V-shaped finned heat exchange plate which comprises the top of the firebox. Heat from the heat exchange plate is convected to circulating air which then exits from the furnace by means of a conduit which is suitable for adaptation to the main heating duct of a conventional domestic heating system.

19 Claims, 6 Drawing Figures

HOT AIR FURNACE

BACKGROUND OF THE INVENTION

This invention relates in general to furnace-type apparata and in particular to modular furnaces which may be adapted for use with a conventional domestic heating system.

Before the widespread availability of modern hot air heating systems, which are designed to use such fuels as natural gas and oil, homes and other structures were typically heated by means of coal-burning or wood-burning furnaces. Since such devices required manual loading of the firebox combustion chamber with an appropriate fuel, the efficiency of the furnace was of particular importance such that the user received the maximum heat out of the particular amount of combustible material being burned. When there is an insufficient supply of oxygen to such a fire, or to a particular portion of the fire, that portion will not experience complete combustion and finely divided particles of the fuel will be exhausted as smoke and soot. This smoke and soot represents both fuel waste as well as heating inefficiency.

Another aspect to the factor of efficiency is to what degree the heat generated by the fuel being burned will be provided to the portions of the structure which require such heat. Heat which escapes up through the exhaust stack of the furnace also represent inefficiency and waste. These and related problems of inefficiency and waste have been the subject of a number of patents which have attempted to provide some improvement to the state of the art as of the time of their conception. The following listed patents provide some indication of the design ideas which have been conceived.

| U.S. Pat. No. | Patentee | Issue Date |
|---|---|---|
| 345,991 | Reynolds | 7/20/86 |
| 503,817 | Watson | 8/22/93 |
| 2,083,745 | Risdon | 6/15/37 |
| 2,130,894 | Muir | 9/20/38 |
| 2,822,136 | Dalin | 2/04/58 |
| 3,934,554 | Carlson | 1/27/76 |
| 2,810,380 | Critten | 10/22/57 |

Reynolds discloses a combined steam generator and radiator wherein the heat from the fire in the firebox is imparted to water in the generator which is disposed above the firebox. Heat from the water is conducted to the air passing through air-circulating tubes which are positioned throughout the generator.

Watson discloses an apparatus for producing and utilizing gas for heating purposes. The apparatus includes a combustion chamber, a grate bar and a plurality of ducts and air passageways formed such that a downdraft is employed to facilitate the combustion of the fuel.

Risdon discloses a furnace design which incorporates a downdraft feature for greater efficiency and a hot water coil disposed within the firebox. A bypass for combustion gases is provided such that the furnace may be used for just the heating of the hot water coil.

Muir discloses a method and means for automatic temperature regulation for a domestic hot water heating system utilizing warm air from a domestic heating furnace. The device incorporates a special heat-dissipating coil positioned in the path of the air flow through the furnace for limiting the upper temperature to which the water may be heated.

Dalin discloses a combined hot air furnace and domestic water heater wherein the total available heat is automatically apportioned between the heating of air and the heating of water based upon the demands of each. The device incorporates a patented heat exchanger construction in an effort to reduce the overall size of the device.

Carlson discloses a water and room-heating unit for extracting heat from combustible material. The heating unit includes a firebox chamber formed from a plurality of water chambers that are arranged in a "U" shape and are interconnected by a first network of pipes which also function as grates and a second network of heat-extracting pipes having radial fins projecting therefrom. The firebox includes an air combustion control and a flue for extracting heat from the combusted gases to heat the surrounding atmosphere.

Critten discloses a wood-burning hot air furnace wherein means are provided for controlled and long burning of each charge of fuel. Automatic controls are included for maintaining substantially uniform temperature in the area being heated. The firebox of the furnace is surrounded by an air jacket for circulating heating air around the sides of the firebox.

Although these various patents disclose devices which attempt to maximize some feature or capability of a furnace, the most optimal construction is one which achieves complete combustion of the fuel being used and transfers a maximum amount of the heat produced by the fuel being combusted to the circulating heating air. Systems which provide combustion air to the firebox in a conventional manner, such as the draft door of the Critten patent, are not suitable for complete combustion due to the entry location of the air relative to the fuel being combusted. Similarly, devices which direct combustion air across only the top of the fire do not supply the necessary oxygen to the interior of the fire. Although there may be devices which introduce air beneath the fire, the optimal arrangement is one which both introduces air uniformly beneath the entire area of the fire an also introduces a portion of the total air above the fire. The reason for this is that as the air passes up through the fire, the oxygen will be used for combustion and in the event unburned particles and combustible gases remain, these combustible materials will move to the top of the fire. By providing a further supply of oxygen at this location above the fire, these remaining combustible materials can be burned. In order to enhance the occurrence of this total and complete combustion, a device having a downdraft feature with a closed top firebox, will temporarily trap the particles and gases in the upper portion of the firebox thereby providing additional time for the combustion of this material. None of the listed patents disclose the combination of such features. Furthermore, none of the listed patents disclose heat exchange means as part of the firebox which provides the most direct and therefore the optimal method of conducting and convecting firebox heat to the surrounding heating air.

Another consideration of any furnace apparatus is the availability of fuel. Due to the fact that heating oil, natural gas, coal and electricity may be of questionable availability during the heating season due to shortages, labor strikes and the inability to deliver due to bad weather, a modular furnace device which is able to burn items such as wood, paper, and coal, and which may be easily adapted to a conventional domestic heating system, offers significant advantages as a backup system when fuel availability is a consideration as well as an alternative when fuel cost is an important consideration.

SUMMARY OF THE INVENTION

A modular furnace for adaptation to a conventional domestic heating system according to one embodiment of the present invention comprises a firebox having a front portion and two side portions, a first grate member disposed within the firebox, a finned heat exchange plate disposed directly atop the firebox, means for providing combustion air into the firebox at a first location above the grate and at a second location below the grate, an external housing portion surrounding the majority of the firebox and a plurality of heating air flow passageways disposed between the firebox and the external housing portion and extending up the two side portions and the front portion and across the heat exchange plate.

One object of the present invention is to provide an improved modular furnace.

Related objects and advantages of the present invention will be apparent from the following description.

DESCRIPTION OF THE PREFERRED EMBODIMENT

Figure 1:
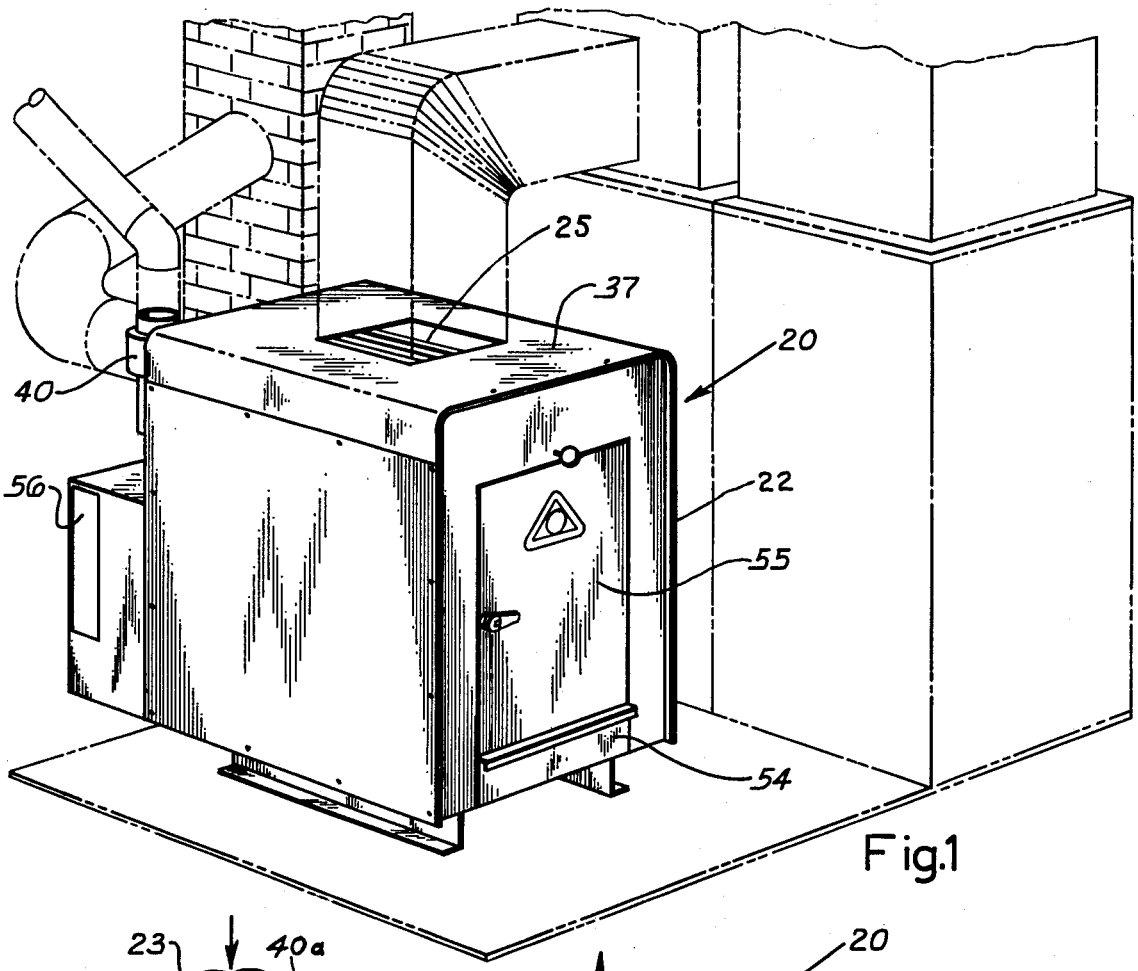
FIG. 1 is a perspective view of a modular furnace according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
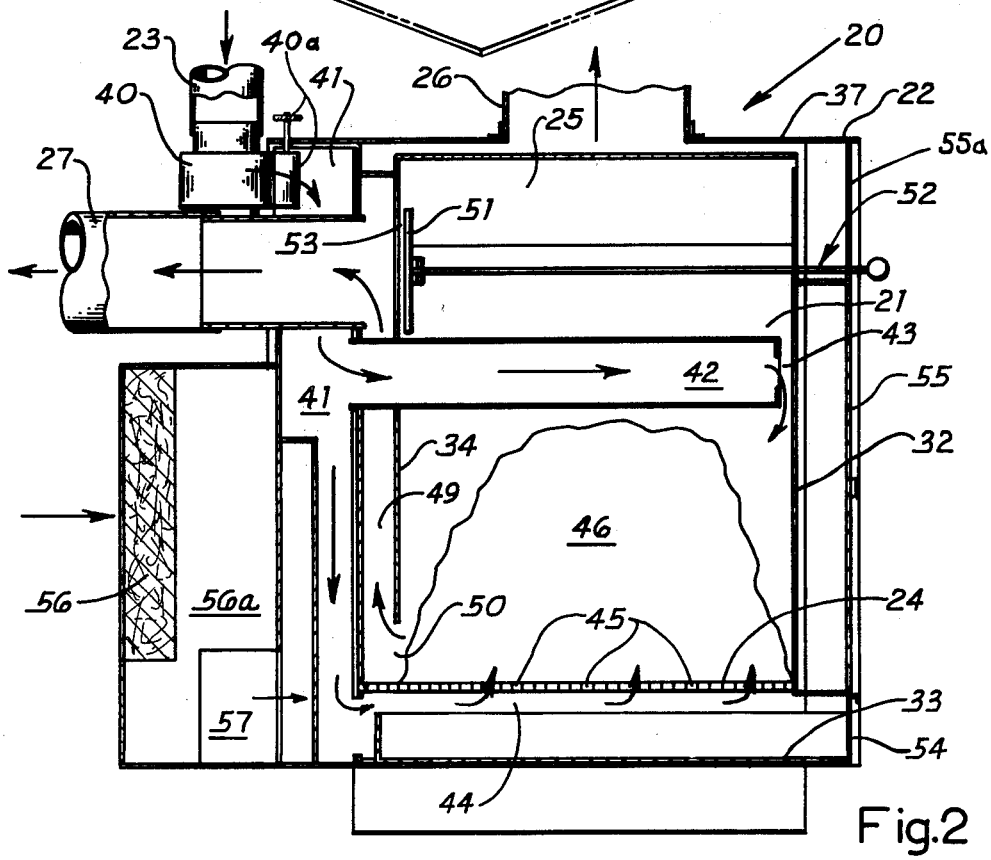
FIG. 2 is a sectioned, side elevation view of the FIG. 1 modular furnace.
Figure 3:
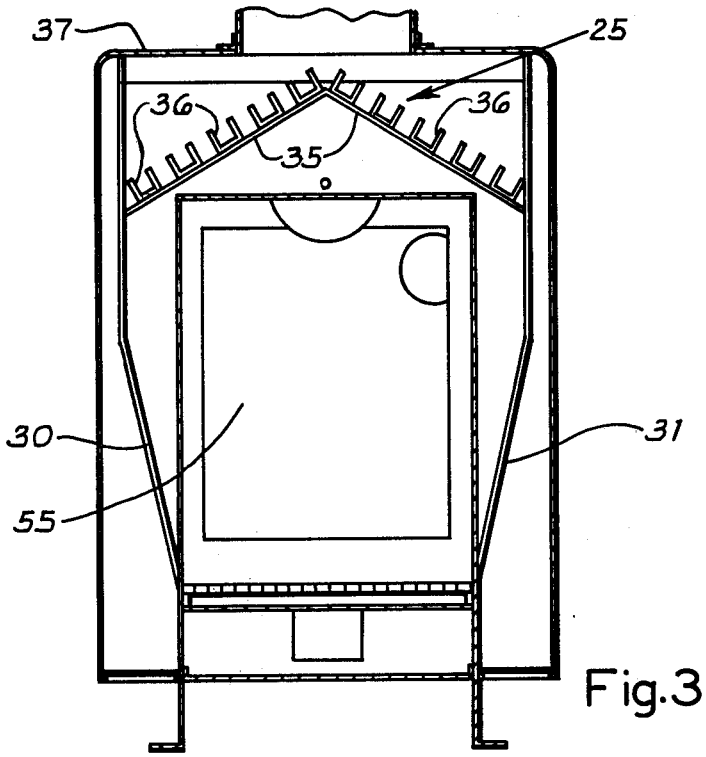
FIG. 3 is a sectioned, front elevation view of the FIG. 1 modular furnace.
Figure 4:
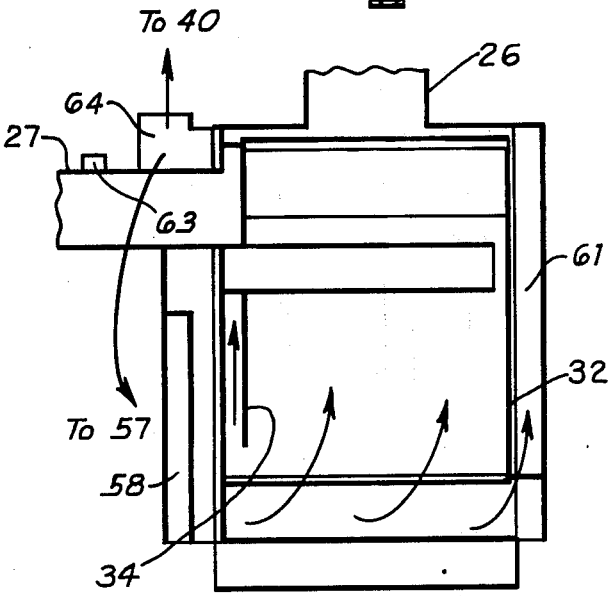
FIG. 4 is a diagrammatic representation of a heating air flow path associated with the FIG. 1 modular furnace.

Referring to FIGS. 1, 2 and 3, there is illustrated a modular furnace 20 which includes a firebox 21, external housing portion 22, main air conduit 23, grate 24, finned heat exchange plate 25, main heating duct 26 and exhaust gas duct 27. Firebox 21 includes left side 30, right side 31, front portion 32, bottom surface 33 and rear surface 34. The otherwise open top of the firebox 21 is enclosed by finned heat exchange plate 25 which is a V-shaped copper plate which converges inwardly and upwardly from left side 30 and right side 31 such that the point of the "V" shape extends toward the top of modular furnace 20. Heat exchange plate 25 includes a base plate portion 35 and a plurality of thin-walled open channels 36 which extend in a substantially parallel relationship to each other from front portion 32 to rear surface 34. Channels 36 open upwardly toward top surface 37 of modular furnace 20 and are secured to base plate 35 by means of mechanical fasteners, welding, brazing or by a similar metal-joining technique. Heat exchange plate 25 is constructed of a material having a high heat transfer coefficient such as, for example, copper and the finned surface area is over 1,100 square inches.

Main air conduit 23 is suitably sized and arranged such that it may be adapted to a conventional air inlet duct which communicates with a source of fresh air, such as the outside, which is in a location remote from the modular furnace 20. This fresh outside air will be introduced to the firebox 21 by means of blower 40 which is positioned in line with main air conduit 23 between the source of outside air and the firebox. Associated with blower 40 and located between blower 40 and chamber 41 is a remotely and manually controllable valve **40*a*. This valve may be used to control the flow of air from blower 40 by orienting valve 40*a* in a selected position between the extremes of closed and fully opened. As this fresh outside air is drawn into the firebox by means of blower 40, it will pass across rear surface 34 of firebox 21 and will experience a moderate degree of preheating. This preheating is further assisted due to the fact that exhaust gas duct 27 passes through chamber 41 such that the air flowing in chamber 41 will be caused to pass over and around the exterior surface of that portion of exhaust gas duct 27 which is disposed in chamber 41. Preheating of the entering combustion air provides a desirable feature in that the temperature of the fire will not be reduced to the same degree as if hit by cold air. Thus, fire temperature is maintained at a higher level. Communicating with chamber 41 and disposed beneath exhaust gas duct 27 is a flow tube 42 which extends from chamber 41 above grate 24 and adjacent front portion 32. Flow tube 42 has a single air outlet opening 43 which is disposed in its outermost end adjacent front portion 32. Also communicating with chamber 41 is an air flow passageway 44 which extends entirely beneath grate 24 and includes a plurality of openings 45 which permit air flow from passageway 44 up through grate 24 and through the substance 46 which is being combusted within firebox 21. The total air flow entering through main air conduit 23 is apportioned between flow tube 42 and air flow passageway 44 based upon the relative cross-sectional areas which are in communication with chamber 41 and pressure differentials at their respective outlets and openings. It is also to be noted that since air introduction is the result of blower 40, combustion air enters the firebox with a positive pressure and the point at which chamber 41 branches into two flow paths is external to the firebox. Although a variety of air flow mixes are possible, depending upon pressures and the cross-sectional area of flow tube 42 and air flow passageway 44, the preferred arrangement is to concentrate a majority, such as 75 percent, of the incoming combustion air through main air conduit 23 to the location of air flow passageway 44 beneath the grate 24. The amount of air which exits from outlet end 43 is utilized for combustion at the upper level of the fire within firebox 21**.

Complete combustion is typically prevented from occurring with conventional fireplaces and furnaces due to the fact that the combustion air is directed across the surface of the fire rather than below and up through the substance being burned. With the present design of air flow passageway 44 extending completely beneath grate 24 and providing a plurality of openings for air flow to pass up through the burning substance, more complete combustion is able to be achieved in an even and uniformly distributed manner such that virtually the entire substance 46 will be uniformly and evenly burned without the need to agitate or stir the coals in order to provide oxygen to the internally trapped regions which would otherwise not experience a complete burn. Furthermore, by providing sufficient oxygen to the fire, fire temperatures are hotter than what would otherwise be possible and this permits the burning of gases and other particle substances which require a higher temperature for combustion and typically comprise the exhaust smoke of conventional furnaces.

Positioned between chamber 41 and the rear surface 34 of firebox 21 is an exhaust chamber 49 which extends between and communicates with firebox 21 and exhaust gas duct 27. Exhaust opening 50 is located in rear surface 34 directly above grate 24 and with exhaust opening 50 in this location, gases and fumes from within firebox 21 must be circulated down to opening 50 in order to be exhausted. This arrangement creates a downdraft wherein the air used for combustion first passes up through the burning substance and gases and unburned particles from the fire are temporarily held in the upper portion of the firebox where they can experience additional combustion, facilitated by yet further combustion air from outlet end 43, and the remaining exhaust is then circulated down to and out opening 50. This downdraft feature which double burns the exhaust further adds to the complete combustion of the substance which is loaded onto grate 24. Once these exhaust gases and fumes pass through opening 50, they are routed outside by means of exhaust chamber 49 and exhaust gas duct 27.

Also provided as part of the combustion air circulation system is a damper 51 and damper-control linkage 52. Damper 51 and damper-control linkage 52 govern outlet 53 which is located at the top of firebox 21 in rear surface 34 and communicates with exhaust gas duct 27. Damper-control linkage 52 may be operated external of modular furnace 20 in order to position damper 51 relative to outlet 53 between a closed position and a fully open position. When outlet 53 is open an updraft will occur with the combustion air within firebox 21 such that a majority of the air utilized for combustion once it passes through the burning substance will be exhausted through outlet 53. The degree to which outlet 53 is open will also determine the proportions of exhaust gas which pass through outlet 53 and which pass through opening 50. The updraft feature provided by means of outlet 53 facilitates the initial starting of the fire by creating a greater flow through the firebox of air entering through front portion 32. Firebox 21 also includes an ash pan 54 which is disposed directly beneath air flow passageway 44 and thus beneath grate 24. Disposed within outer wall **55*a* which is substantially parallel with front portion 32 is a door member 55 which opens outwardly for the loading of a combustible substance 46 onto grate 24. With door member 55 open, sufficient oxygen is provided to substance 46 so that a fire may be started. Once the fire has been started, door member 55 is closed and blower 40 is activated in order to establish and provide the requisite combustion air circulation through firebox 21 and out exhaust gas duct 27**.

Figure 5:
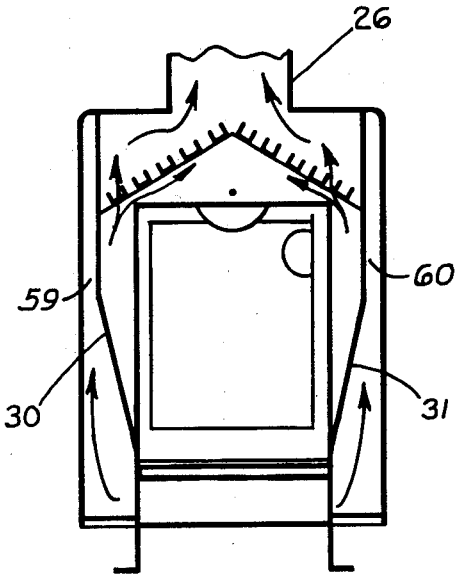
FIG. 5 is a diagrammatic representation of a heating air flow path associated with the FIG. 1 modular furnace.

By providing complete combustion within firebox 21 of whatever substance is being burned, fuel utilization is maximized, and by providing a finned heat exchange plate 25 at the top of firebox 21 virtually all the heat which is generated within firebox 21 by the fire will be conducted to the sides of the firebox and may be convected therefrom by a suitable air flow pattern. Inasmuch as external housing portion 22 surrounds a majority of firebox 21 and is spaced therefrom, a plurality of air flow passageways are provided between housing portion 22 and the external surfaces of firebox 21. Inasmuch as the air which is circulated through the plurality of air passageways will be utilized for heating of remote areas of the structure with which modular furnace is utilized, it is important that there be no possibility of combustion fumes mixing with the circulating heating air. To further enhance the cleanliness aspect of the circulated heating air, modular furnace 20 includes in heating air chamber **56*a* an air filter 56 and air blower 57 which draw in and filter air from within the structure or from the cold air return duct of the structure and route this air up the exterior of rear surface 34, up the exterior of left side 30 and right side 31 and up the exterior of front portion 32 on either side of door member 55. It is air blower 57 which provides the heating air inlet means to the various heating air passageways associated with modular furnace 20. The selected air filter 56 is 95 percent efficient at 5 microns thereby providing extremely clean air for heating. While four different air flow passageways 58, 59, 60 and 61 are identified, there exists flow communication between all four. Incoming air passes from passageway 58 into passageways 59 and 60 and rises upwardly toward the top of the furnace as well as continues forward toward passageway 61. Passageways 59 and 60 are in flow communication with front passageway 61 which is split into two branches, one on each side of door member 55. The air flow from the side passageways into these two branches extends the length of the flow path from the point of entry to the point of exit and thereby holds the air inside the furnace longer allowing greater heat absorption. The upward flow through these two branches unites above door member 55 into a common flow path such that the air then flows across the heat exchange plate prior to exiting. While the top of passageways 59 and 60 are, in the exemplary embodiment, blocked from direct communication with duct 26 (see FIG. 5), the flow of air in such passageways unite near the top of passageway 61 and flows across finned heat exchange plate 25 within a common flow passageway. Due to the fact that modular furnace 20 is predominantly of a metal or metal alloy construction, the heat generated within firebox 21 will be conducted throughout the various surfaces of firebox 21 and the exterior surfaces of firebox 21 will be able to give up this heat by the action of convection to a circulating air flow which is at a temperature lower than that of the firebox surfaces across which the air passes. Consequently, the air flow through the four air flow passageways 58–61 will extract heat from their corresponding surfaces of firebox 21 as they flow upwardly toward finned heat exchange plate 25. Although this elevates the temperature of the circulating air and reduces the temperature differential between the firebox surfaces and the circulating air, the finned heat exchange plate 25 is at a significantly higher temperature than are the sides of firebox 21 due to the fact that the fire burns directly upward and provides a greater heat intensity directly above the fire than is radiated outwardly to the front, back and sides. Consequently, as this preheated air passes across finned heat exchange plate 25 a significant temperature differential still exists between the circulating air and plate 25 which permits yet further heat to be convected from the surface of heat exchange plate 25 to this circulating air. Consequently, virtually all the heat generated by the burning substance within firebox 21 will be convected to the circulating air being provided by blower 57 so long as the air flow rate capacity of blower 57, expressed in CFM, is sufficient to keep pace with the heat being generated. A circulating air blower rated at 300 CFM is suitable for blower 57 as disclosed for use with the modular furnace 20**.

Although not specifically illustrated, it is to be understood that main heating duct 26 may be connected directly to a remote space to be heated but it is preferably attached to the main heating outlet duct of a conventional domestic heating system furnace such that the entire ductwork arrangement for a structure can be supplied by heated air from modular furnace 20. This permits modular furnace 20 to be installed as a single unit adjacent a conventional domestic heating system furnace and to be quickly and inexpensively adapted to the ductwork associated with the conventional domestic heating system furnace (see FIG. 1) so that in the event of fuel shortages or high-cost fuels, modular furnace 20 may be used as an alternative. In the event a combustible substance such as wood would be in great abundance, it is conceivable that modular furnace 20 would be utilized as the primary heating source. This would permit one to save on natural gas or heating oil expenses during particularly severe winters. Due to the fact that there is complete combustion and a very clean burn of the substance loaded onto grate 24, modular furnace 20 performs in an extremely efficient manner permitting maximum utilization of the heat capacity from the particular combustible substance. Furthermore, by the design of air flow passageways 58–61 up, over and around firebox 21, the majority of the heat which is generated within firebox 21 is transferred to the air which is utilized for heating. By holding the fire in the firebox 21 an extended period of time by means of the downdraft feature, the generated heat radiates to the sides and top of the firebox rather than being lost as exhaust. This heat transfer direction is facilitated by a rapid convection from the outer surfaces to the circulating air so that a sufficient temperature difference is maintained between the firebox surfaces and the fire to encourage radiation of heat to these surfaces.

Also associated with modular furnace 20 is a rechargeable battery-pack system 64 which is operable to provide the necessary voltage potential for blowers 40 and 57 in the event there is an electrical outage or electrical service is otherwise interrupted. This means that in the event there would be an electric power failure, modular furnace 20 could still perform and deliver the heating requirements to the particular structure. A further feature is provided by thermostat 63 which is located on exhaust gas duct 27 to control overheating. Such a thermostat may be located at other locations such as in duct 26 to sense the temperature at a particular location. By coupling such a thermostat to one or the other of the blowers, air flow can be cut off when a certain temperature is reached.

Figure 6:
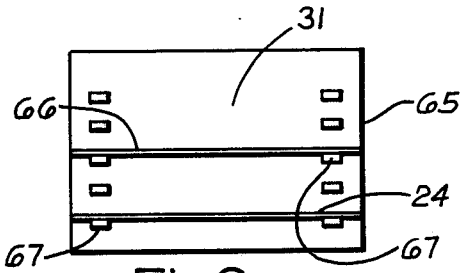
FIG. 6 is a side elevation view of one side of a firebox which comprises a portion of the FIG. 1 modular furnace.

Referring to FIG. 6, there is illustrated one side of the firebox of an alternate arrangement of modular furnace 20 wherein firebox 65 includes a first grate 24 and a second grate 66 which is substantially parallel to grate 24 and of substantially the same size and shape. These two grates are positioned within the firebox and extend from front portion 32 to rear surface 34 and between left side 30 and right side 31, although only right side 31 is illustrated, in much the same manner as did grate 24 when associated with firebox 21. Grate 24 and grate 66 are positioned approximately six inches apart and supported by shelf brackets 67. A plurality of sets of shelf brackets 67 are disposed on the internal surfaces of left side 30 and right side 31 on three-inch centers in such a manner as to permit grates 24 and 66 to be independently positioned at any one of a number of different heights and different separations. Although a similar construction utilizing shelf brackets 67 is possible with firebox 21 as illustrated in FIG. 1, when only one grate is being utilized, its position may be rigidly established at a single location directly above the air flow shelf which provides combustion air up through the internal portion of the burning substance. However, with a plurality of grates, understanding that more than two may be utilized, selective positioning of the grates at different heights within the firebox as well as employing different distances of separation between adjacent grates may be desirable, depending upon the particular substance being burned. By providing a plurality of grates, the same volume of combustible substance may be evenly distributed in a plurality of masses rather than requiring that one fuel charge be lumped in one place on one grate. By spreading out the particular volume of combustible substance 46, greater heat distribution and greater combustion air flow will be permitted up, around and through the combustible substance 46 further facilitating the cleanliness and completeness of the combustion and providing a minimal amount of ash, smoke and soot.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A modular furnace for adaptation to a conventional domestic heating system, said modular furnace comprising:

a firebox having a front opening and two side portions;

a first grate member disposed within said firebox;

a finned heat exchange plate disposed directly atop said firebox;

means for introducing combustion air into said firebox at a first location above said first grate member and at a second location underneath the entire surface of said first grate member;

an external housing portion surrounding a majority of said firebox, said external housing portion having a heating air inlet and a heating air outlet; and a plurality of heating air flow passageways defined by and disposed between said firebox and said external housing portion, said plurality of heating air flow passageways including two side passageways closed at their uppermost ends and a front passageway extending upwardly on opposite sides of said front opening, each of said two side passageways being in flow communication with corresponding side portions of said front passageway and said front passageway being arranged such that flow from said two side passageways into said front passageway unites to create a common air flow path across said heat exchange means prior to exiting from said heating air outlet.

2. The modular furnace of claim 1 wherein said introducing means includes a main air conduit disposed between a source of outside air and said firebox and a blower cooperating with said main air conduit to provide outside air into said firebox.

3. The modular furnace of claim 2 wherein said introducing means further includes a flow tube communicating with said main air conduit and extending to said first location above said first grate member and adjacent said front portion of said firebox, said main air conduit being centrally disposed relative to said first grate member.

4. The modular furnace of claim 3 wherein said flow tube includes a single outlet aperture opening into said firebox.

5. The modular furnace of claim 1 which further includes a heating air inlet chamber having an air filter and an air circulating blower disposed therein, said blower providing said heating air inlet.

6. The modular furnace of claim 5 wherein said heating air outlet is disposed in said external housing portion at a location above and central to said finned heat exchange plate.

7. The modular furnace of claim 3 which further includes an exhaust gas duct communicating with the interior of said firebox at a first location adjacent said first grate member.

8. The modular furnace of claim 7 wherein said exhaust gas duct further communicating with the interior of said firebox through an outlet at a second location adjacent said finned heat exchange plate.

9. The modular furnace of claim 8 wherein said outlet includes damper means operable between an outlet closed position and an outlet fully open position.

10. The modular furnace of claim 9 wherein said exhaust gas duct extends through said main air conduit such that the flow direction of outside air through said main air conduit is substantially perpendicular to the flow direction of exhaust gases through said exhaust gas duct.

11. The modular furnace of claim 4 wherein said single outlet aperture is located in the outermost end of said flow tube adjacent said front portion of said firebox.

12. The modular furnace of claim 1 which includes a second grate member disposed within said firebox above said first grate member, said second grate member being substantially parallel to said first grate member.

13. The modular furnace of claim 12 wherein said first and second grate members are selectively and independently positionable at any one of a plurality of different locations within said firebox.

14. The modular furnace of claim 13 wherein said introducing means includes a main air conduit disposed between a source of outside air and said firebox and a blower cooperating with said main air conduit to provide outside air into said firebox.

15. The modular furnace of claim 14 wherein said introducing means further includes a flow tube communicating with said main air conduit and extending to said first location above said second grate member and adjacent said front portion of said firebox.

16. The modular furnace of claim 1 wherein said heat exchange plate is V-shaped, the two sides of said heat exchange plate converging inwardly and upwardly from said two side portions of said firebox.

17. The modular furnace of claim 16 wherein said V-shaped heat exchange plate is constructed of a copper alloy and includes a plurality of longitudinally extending fins.

18. The modular furnace of claim 17 wherein said introducing means includes a main air conduit disposed between a source of outside air and said firebox and a blower cooperating with said main air conduit to provide outside air into said firebox.

19. The modular furnace of claim 18 wherein said introducing means further includes a flow tube communicating with said main air conduit and extending to said first location above said first grate member and adjacent said front portion of said firebox, and said flow tube including a single outlet aperture opening into said firebox.

* * * * *